US010352117B2

(12) United States Patent
O'Connor

(10) Patent No.: US 10,352,117 B2
(45) Date of Patent: Jul. 16, 2019

(54) LOW PROFILE REMOTE TRIGGER FOR HYDROSTATICALLY SET BOREHOLE TOOLS

(71) Applicant: BAKER HUGHES, LLC, Houston, TX (US)

(72) Inventor: Keven O'Connor, Houston, TX (US)

(73) Assignee: BAKER HUGHES, LLC, Houston, TX (US)

( * ) Notice: Subject to any disclaimer, the term of this patent is extended or adjusted under 35 U.S.C. 154(b) by 129 days.

(21) Appl. No.: 15/234,716

(22) Filed: Aug. 11, 2016

(65) Prior Publication Data

US 2018/0045004 A1 Feb. 15, 2018

(51) Int. Cl.
*E21B 23/00* (2006.01)
*E21B 23/01* (2006.01)

(52) U.S. Cl.
CPC ..... *E21B 23/00* (2013.01); *E21B 23/01* (2013.01)

(58) Field of Classification Search
CPC ..... E21B 23/00; E21B 23/01; E21B 43/116
See application file for complete search history.

(56) References Cited

U.S. PATENT DOCUMENTS 5,025,861 A * 6/1991 Huber ..... E21B 17/028 166/217
5,680,905 A * 10/1997 Green ..... E21B 43/11852 166/297
6,021,095 A * 2/2000 Tubel ..... E21B 23/00 166/166
6,382,234 B1 5/2002 Birckhead et al.
7,819,198 B2 10/2010 Birckhead et al.
2016/0168945 A1* 6/2016 Halbert ..... E21B 33/129 166/118

* cited by examiner

*Primary Examiner* — David J Bagnell
*Assistant Examiner* — Manuel C Portocarrero
(74) *Attorney, Agent, or Firm* — Shawn Hunter

(57) ABSTRACT

A pin whose movement triggers setting of the borehole tool, is initially held by a collet that is supported off a surrounding housing. A spring is supported off the pin and would push a housing that locks the collet to the pin axially to unsupport the collet but for the presence of a Kevlar® wire that has an associated heater. The wire pulls the housing that locks the collet against the spring bias and has an end attached to the pin. Melting the wire allows the spring to move the housing that traps the collet to the pin. At that point hydrostatic pressure can move the pin to either open a port on the borehole tool to set it hydrostatically or to move an actuation rod attached to the pin to set the borehole tool mechanically or with a combination of mechanical and hydraulic force.

16 Claims, 4 Drawing Sheets

LOW PROFILE REMOTE TRIGGER FOR HYDROSTATICALLY SET BOREHOLE TOOLS

FIELD OF THE INVENTION

The field of the invention is trigger devices for hydrostatically set borehole tools and more particularly where the restraint is in axial alignment with the trigger to reduce the tool profile.

BACKGROUND OF THE INVENTION

Tools have been remotely triggered in the past by a variety of ways. One way shown in U.S. Pat. No. 6,382,234 is to use an electric heater to melt a plug that then opens a flow port to allow an actuating piston to displace. In this device the actuating piston is not mechanically restrained, rather fluid is retained by a plug. As long as the fusible plug is intact the fluid ahead of the piston has nowhere to go. When heat melts the plug the fluid can be displaced as the setting piston responds to a spring force unleashed by the fluid ahead of the piston having a place to be displaced.

Another design shown in U.S. Pat. No. 7,819,198 holds a coiled spring in a wound state around an actuator. A wire holding the spring and surrounding housing over the actuator is melted which allows the spring to radially displace the components retaining the actuator radially so that the actuator can move axially to set a tool.

The latter design stacks components radially which dramatically increases the diameter of the lock for the tool actuator. In some applications space is simply not available for such a bulky lock mechanism. Melting a fusible plug as in the former design also requires a great deal of power to generate the heat needed to defeat the fusible plug. There are further uncertainties with the degree of melting that insures the ability to displace enough fluid at the needed rate to get the ultimate borehole tool to set.

What is needed and provided with the present invention is a low profile design that aligns the mechanical restraint axially with the lock elements and the shaft or pin that needs to move to get the tool set either by opening a port to take advantage of available hydrostatic or to move an actuation rod when the available hydrostatic may be insufficient to actuate the borehole tool. These and other aspects of the present invention will be more readily apparent from a review of the description of the preferred embodiment and the associated drawing, while recognizing that the full scope of the invention is to be determined from the appended claims.

SUMMARY OF THE INVENTION

A pin whose movement triggers setting of the borehole tool, is initially held by a collet that is supported off a surrounding housing. A spring is supported off the pin and would push a housing that locks the collet to the pin axially to unsupport the collet but for the presence of a Kevlar® wire that has an associated heater. The wire pulls the housing that locks the collet against the spring bias and has an end attached to the pin. Melting the wire allows the spring to move the housing that traps the collet to the pin. At that point hydrostatic pressure can move the pin to either open a port on the borehole tool to set it hydrostatically or to move an actuation rod attached to the pin to set the borehole tool mechanically or with a combination of mechanical and hydraulic force.

DETAILED DESCRIPTION OF THE PREFERRED EMBODIMENT

Figure 1:
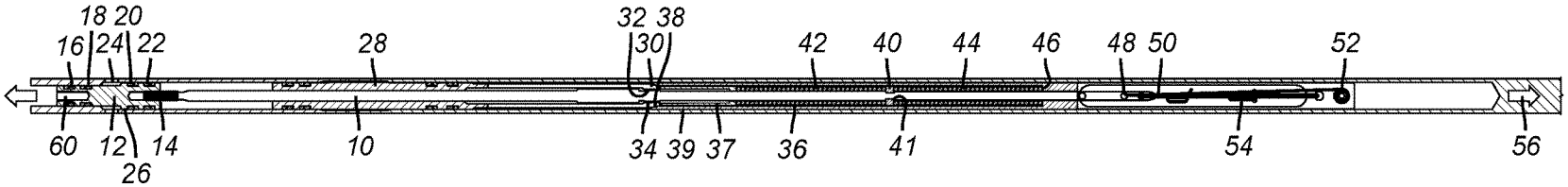
FIG. 1 is a section view of the setting tool in the run in position.

FIG. 1 shows a pin 10, connected to a bias piston 12 at thread 14, forming the axially movable assembly. The bias piston 12 has seals 16 and 18 to the left of port 24 and seals 20 and 22 to the right of port 24. A collet assembly 28 has individual heads 30 with a grip pattern 32 to engage grip pattern 34 on the pin 10, collectively comprising the locking member. An inner sleeve 36 acts as a retaining member and has an end taper 38 to initially wedge the heads 30 against the pin 10. A snap ring or other retainer 40 sits in a groove 41 in the pin 10. On the right side of the retainer 40 is a spring 44 and on the left side of the retainer 40 is a spring 42. Spring 44 pushes on shoulder 46 of the outer housing 49. Pin 10 has an opening 48 through which a wire or other elongated retainer 50 extends to mounting location 52 on the inner sleeve 36. Since the pin 10 is unable to move initially due to the engagement of patterns 32 and 34, the bias of spring 44 on inner sleeve 36 to the right is resisted by the retainer 50. Restraint 50 can be defeated by a heater 54 powered remotely from an electronics package and power supply presented schematically as arrow 56.

Figure 2:
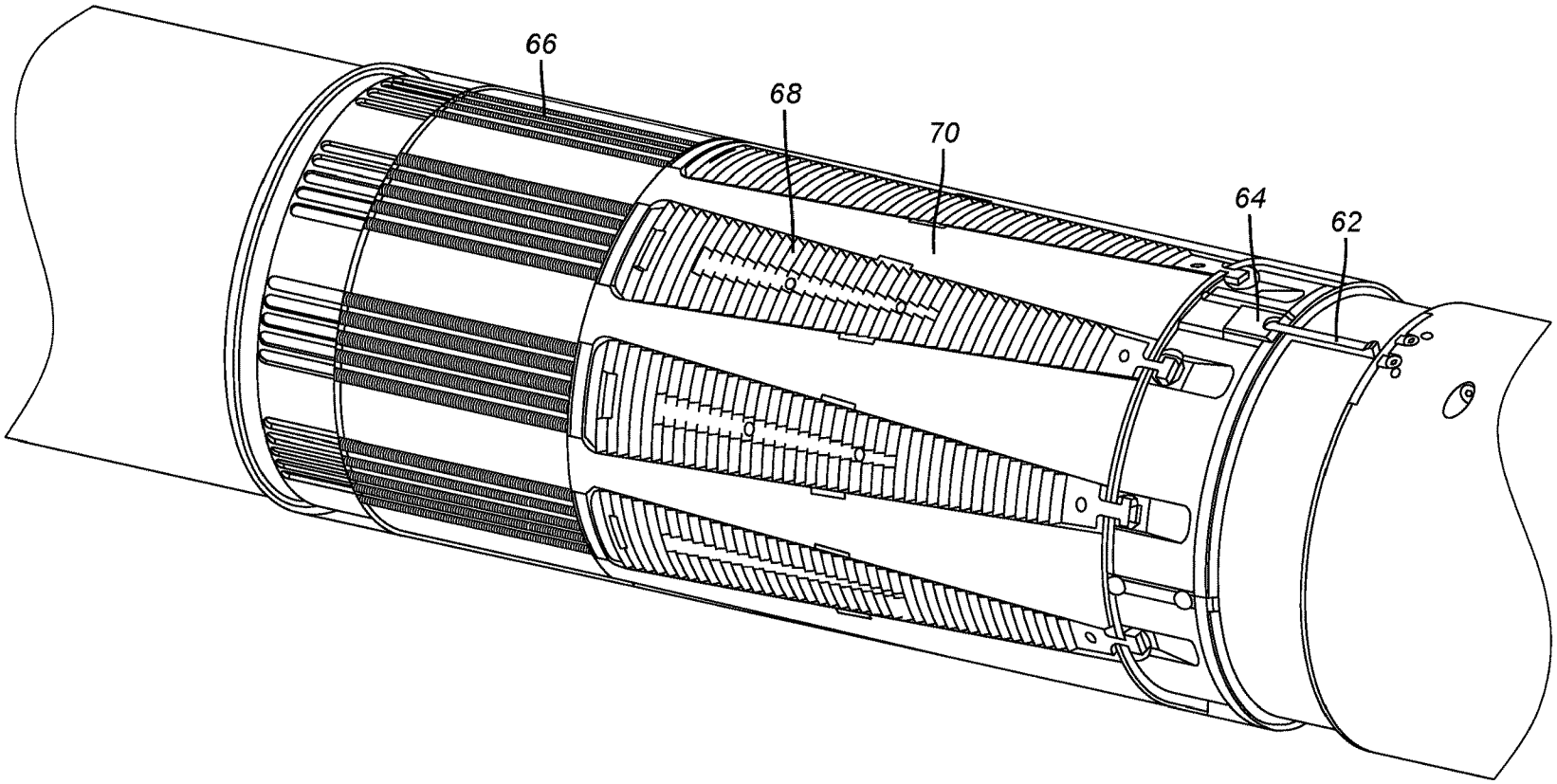
FIGS. 2-4 show a potential use of the setting tool transmitting mechanical force to set an associated borehole tool.
Figure 3:
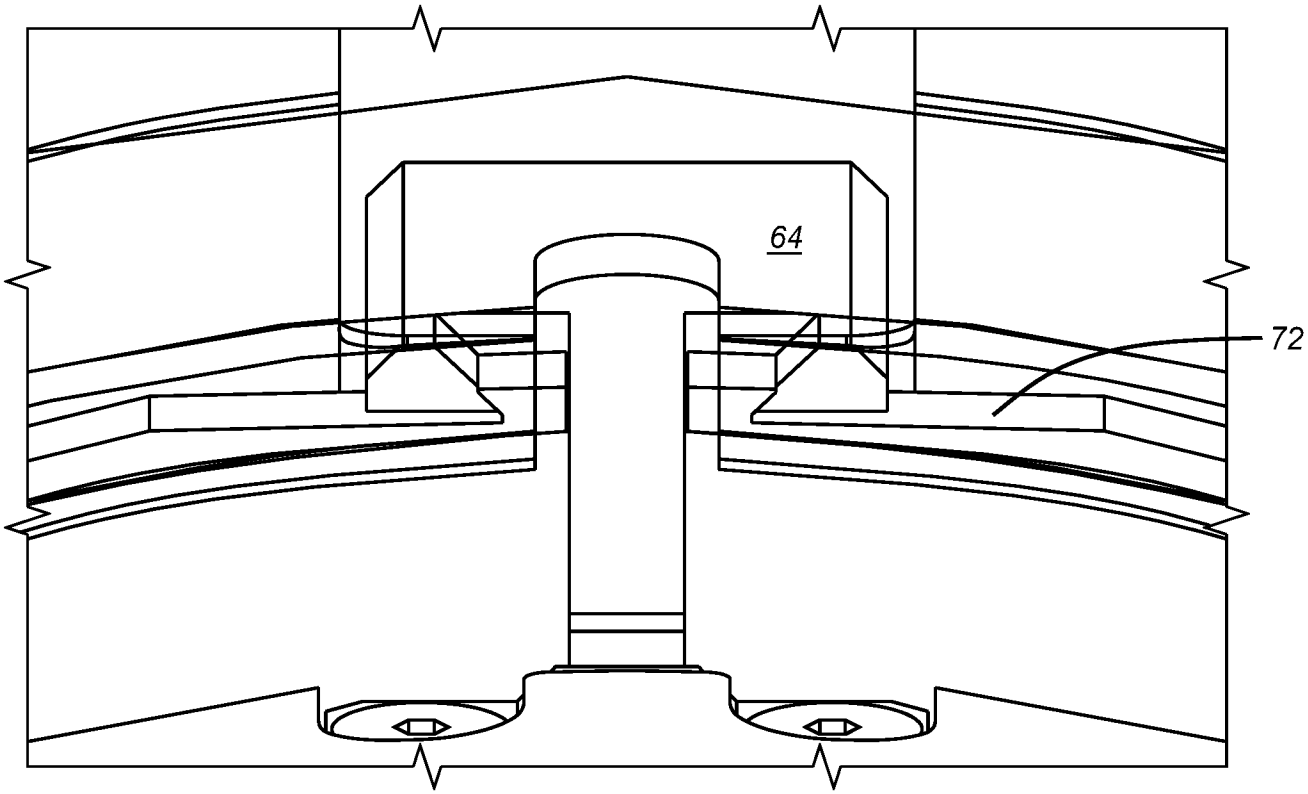
Figure 4:
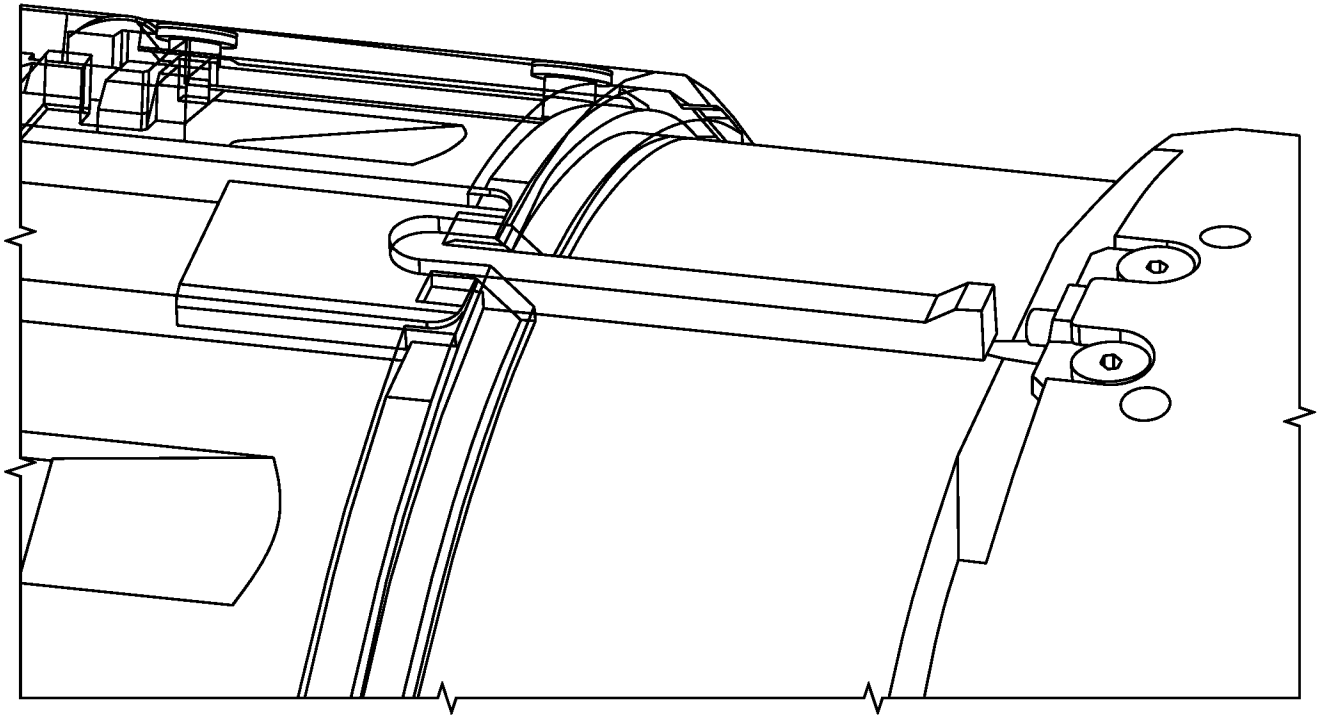

To set a tool associated with this assembly, the pin 10 has to move to the right. Once the heater 54 burns through the retainer 50, the force of spring 44 moves inner sleeve 36 to the right which moves tapered surface 38 out from behind the collet heads 30 so that heads 30 can move out radially toward the surrounding outer housing 39. This allows patterns 32 and 34 to separate. The hydrostatic pressure at port 24 pushes bias piston 12 to the right. The piston 12 can be configured to be pushed right as in FIG. 1 or it can be configured to push the opposite direction. Movement of piston 12 can either admit hydrostatic pressure to a setting chamber for a borehole tool or through a link connected at thread 60 a mechanical force can be transmitted to a setting assembly for a borehole tool so that the borehole tool can be set with hydrostatic force or mechanical force or a combination of the two forces. It should be noted that for running in the spring 42 pushes sleeve 37 against heads 30. When retainer 50 is broken engagement patterns 32 and 34 as well as sleeve 37 pushes out heads 30 toward the outer housing 39 as pin 10 with pattern 34 move right and under an undercut in sleeve 37. It should also be noted that piston 12 can be urged to move left by configuring seals 20 and 22 to be smaller than seals 16 and 18. In that configuration the pin 10 and the piston 12 will move left instead of the configuration of FIG. 1 where the resulting component movement is to the right. Movement to the left can accommodate the design in FIGS. 2-4.

For example, for a configuration where the piston 12 is configured to move left instead of to the right as shown, that movement can push a link 62 to move a retainer 64 axially to allow springs 66 to pull up slips 68 relative to tapered guides 70 for radial extension of slips 68 which are part of a liner hanger. This happens because retainer 64 holds together band 72. When band 72 is allowed to grow circumferentially after retainer 64 moves axially the force of springs 66 takes over to set the liner hanger by radially extending the slips 68.

Those skilled in the art will appreciate that the alignment of the retainer 50 axially allows a lower profile design for the assembly. The use of a coiled spring 44 within sleeve 36 further contributes to the low profile. Using the axially oriented Kevlar® wire assures that it will fail reliably with applied heat to allow stored potential energy in the tool to move components axially to allow ultimate movement of piston 12 in the desired direction for hydraulic and/or mechanical setting of the borehole tool, one example of which is a liner hanger.

The above description is illustrative of the preferred embodiment and many modifications may be made by those skilled in the art without departing from the invention whose scope is to be determined from the literal and equivalent scope of the claims below:

I claim:

1. A trigger assembly for operating a borehole tool, comprising:

a housing:

an axially moveable assembly selectively initially retained by a locking member, said locking member defeated with axial movement of a retaining member, said retaining member being a distinct component from said axially moveable assembly and where axial movement of said retaining member is enabled with defeat by rupture of an axially oriented elongated restraint which extends axially along its length between a mounting location on the retaining member and the locking member, said defeat of said axially oriented restraint to release the locking member occurring before movement of said retaining member, to allow said locking member to disengage said movable assembly for axial movement of said movable assembly with respect to said housing and said retaining member with said retaining member remaining in said housing, said movement operating the borehole tool.

2. The assembly of claim 1, wherein:

said retaining member selectively initially secured to said axially moveable assembly.

3. The assembly of claim 2, wherein:

said retaining member is retained against a bias that would otherwise move said retaining member to allow said locking member to disengage said movable assembly.

4. The assembly of claim 3, wherein:

said restraint comprises a wire defeated with applied heat.

5. The assembly of claim 4, wherein:

said wire is made of polyparaphenylene terephthalamide and is undermined with electricity applied to a nichrome wire wrapped around said polyparaphenylene terephthalamide wire.

6. The assembly of claim 3, wherein:

said bias comprises at least one spring supported on one end from said axially movable assembly.

7. The assembly of claim 1, wherein:

said selective engagement of said locking member to said axially movable assembly is with meshing profiles on each being in engagement with said engagement maintained by a position of said retaining member.

8. The assembly of claim 7, wherein:

said locking member comprises at least one collet having a head on which one of said meshing profiles is located.

9. The assembly of claim 8, wherein:

said locking member further comprises a sleeve biased against said at least one head from a location on said axially movable assembly.

10. The assembly of claim 9, wherein:

said meshing profile on said axially movable assembly moves within said sleeve as a result of axial movement of said retaining member.

11. The assembly of claim 1, wherein:

said axially moveable assembly relatively moveable with respect to said housing using hydrostatic pressure directed to a bias piston comprising a part of said axially movable assembly.

12. The assembly of claim 11, wherein:

said bias piston moving out of said housing on release of said axially movable assembly.

13. The assembly of claim 11, wherein:

said bias piston moving into said housing on release of said axially movable assembly.

14. The assembly of claim 11, wherein:

said bias piston has opposed unequal piston areas.

15. The assembly of claim 11, wherein:

said bias piston further comprises a link connected to thereto and extending from said housing for operable connection to the borehole tool for mechanical actuation thereof.

16. The assembly of claim 11, wherein:

movement of said bias piston directs hydrostatic pressure to the borehole tool for hydraulic actuation thereof.

* * * * *